US005850802A

United States Patent [19]

Dvorak

[11] Patent Number: 5,850,802

[45] Date of Patent: Dec. 22, 1998

[54] COLLAPSIBLE BOAT ANCHOR

[76] Inventor: Ryan T. Dvorak, 3670 N. Moorpark Rd., Thousand Oaks, Calif. 91360

[21] Appl. No.: 895,157

[22] Filed: Jul. 16, 1997

[51] Int. Cl.[6] ..... B63B 21/24

[52] U.S. Cl. ..... 114/303; 114/301

[58] Field of Search ..... 114/294, 301, 114/303; D12/215

[56] References Cited

U.S. PATENT DOCUMENTS

| | | | |
|---|---|---|---|
| 1,139,202 | 5/1915 | Masak | 114/301 |
| 1,325,693 | 12/1919 | Deam | 114/303 |
| 4,224,892 | 9/1980 | Sandberg | 114/294 |
| 4,337,717 | 7/1982 | Gregory | 114/294 |
| 4,523,539 | 6/1985 | Granger | 114/299 |
| 4,577,581 | 3/1986 | Puech | 114/294 |
| 4,732,105 | 3/1988 | Fisher | 114/301 |
| 4,958,586 | 9/1990 | Stupakis | 114/303 |
| 5,054,416 | 10/1991 | Zetah | 114/310 |

*Primary Examiner*—Ed L. Swinehart

[57] ABSTRACT

A collapsible boat anchor (12) comprising four side panels (13, 13*a*, 13*b* and 13*c*) each hingeably connected to the next as to form a square. To the forward and rearward side panels (13 and 13*b*) respectively are affixed a plurality of flukes (14 through 20*a*) arranged in upper and lower configuration as to allow the anchor (12) to set on whichever side it may fall. Moveable attached to the inside of the anchor at forward side panel (13) and right side panel (13*c*) is a center stabilizing bar (30). The center stabilizing bar (30) secures the anchor in an open and locked position while engaged, but facilitates collapse of the anchor for storage while disengaged. To provide a tie-off location for an anchor line, a lead arm (28) is pivotably affixed to the anchor at a anchor pull ring (26).

5 Claims, 5 Drawing Sheets

COLLAPSIBLE BOAT ANCHOR

BACKGROUND

1. Field of the Invention

The field of this invention relates to boat Anchors and more particularly to a collapsible anchor to provide excellent holding characteristics in most bottom conditions, while easy to retrieve from the bottom and capable of folding down flat for storage.

2. Description of Prior Art

In boating, anchoring is an essential aspect. Anchors would be used for example to provide a temporary mooring while fishing, camping or putting into harbor. Anchors are also used as an emergency safeguard to prevent wind and current from throwing a boat ashore should it become disabled while in the water.

Many attempts have been made to provide an anchor of acceptable holding power in a wide variety of bottom conditions, yet convenient to store and light weight enough to be quickly and easily deployed by the boater.

It has also been of concern to design an anchor that can be easily removed from the bottom once it has been set, as inability to remove a snagged anchor makes it necessary to cut the anchor line for the boat to continue on its way.

Anchors of prior art, though usually effective if used in their intended environment are of less practical use on the smaller recreational boats found in the shallower water of lakes, rivers, and inland waterways.

Many anchors, as recommended by their manufacturers, require additional gear to be effective. This would include for example a substantial length of lead chain and a number of anchor shackles. This can be somewhat cumbersome on a smaller boat. Storage and speed of deployment would also be adversely effected.

Other anchors requiring no additional means and more specifically designed for lake, river, and inland waterway boating are far more convenient, yet provide limited holding power in all but specific bottom environments.

In respect to anti-snag features, most anchors of prior art have relied on methods such as secondary "trip" line attached to a second ring on the anchor or a reversible sleeve slideably mounted on the shank. These methods greatly increase the possibility of lines or mechanisms becoming fouled under water. Both methods rely on additional gear instead of alternate anchor design to solve the problem.

Several styles of these and other pertinent prior art can be seen in U.S. Pat. Nos. 1,139,202 to Masak, 1,325,693 to Deam, 4,3337,717 to Gregory, 4,523,539 to Granger, 4,577,581 to Puech and 4,732,105 to Fisher.

The use of a spring mechanism to release an anchor from the bottom can be seen in U.S. Pat. No. 5,054,416 to Zetah. This method could cause the anchor to un-intentionally release should a great amount of load be applied from the anchored boat due to wind or current.

It would be particularly useful to develop an anchor for lake, river and inland waterway boating requiring no lead chain or additional gear having substantial holding power in most bottom conditions, easy to retrieve from the bottom once set and capable of folding down flat for storage in a minimum of time.

SUMMARY OF THE INVENTION

Therefore it is the object of this invention to provide a boat anchor comprising four equal side panels each panel hingably connected to the next as to form a square. The hinged configuration allows for the anchor to be folded down flat after disengagement of a movable center stabilizing bar, allowing for compact storage. A plurality of flukes affixed to the forward and rearward side panel in an arrangement as to allow the anchor to set on whichever side it may fall. A lead arm pivotably attached to a pull ring mounted on the forward facing panel of the anchor. The lead arm providing a location to secure an anchor line and serving to prevent the anchor line from fouling the anchor on deployment.

DESCRIPTION OF THE PREFERRED EMBODIMENT—FIGS. 1, 2, 3, 3A, 4, 5, 6

Referring now to FIG. 1, an anchor according to the present invention is shown and referred to in general by the reference numeral 12. Collapsible boat anchor 12 comprises four equal, horizontally extending side panels. A side panel 13, a left side panel 13*a,* a rearward side panel 13*b,* a right side panel 13*c.* The shape of each side panel would be that of a rectangle approximately 28 cm long by 7 cm wide and made of about 0.5 cm thick rigid material such as steel (galvanized or stainless). Aluminum or iron would also be suitable. Each side panel is hingeably attached to the next, end to end, at continual right angels by a hinge 22, thus forming the geometric shape square of a perfect square. Hinge 22 is held intact by a hinge pin 24 (FIG. 2) These connected panels will form the foundation of the anchor. The hinge pin is also removable for complete disassembly if necessary for part replacement.

With the side panels hinged at all four corners it is necessary to provide a method for preventing the anchor from collapsing in on itself during use. This is achieved by use of a downward facing, elongated "U" shaped center stabilizing bar assembly shown in general in FIGS. 1, 2, 3, 4 and 5 as reference number 30. The stabilizing bar consists of an about 1 cm round bar with a 90° bend at each end, all spanning approximately 20 cm.

Referring now to FIG. 2, 3 and 3*a* center stabilizing bar 30 is shown also including a center stabilizing bar plunger leg 30*a,* and a center stabilizing bar receiving leg 30*b.* Plunger leg 30*a* and receiving leg 30*b* are located at opposite ends of the stabilizing bar assembly. Note that leg 30*b* is shorter than 30*a,* more on this later. To hold the anchor in a secure open position, plunger leg 30*a* is slid downwardly into a plunger tube 32, the plunger tube having been permanently affixed to the inside of forward panel 13 at a predetermined location. Simultaneously, receiver leg 30*b* is slid downwardly into receiver tube 34, also permanently affixed to the inside of right side panel 13*c* at a location. Plunger tube 32 and receiver tube 34 would be about 2 cm in length and have sufficient inside diameter as to accept stabilizing bar 30. Stabilizing bar 30 having been fully engaged into plunger tube 32 and receiver tube 34, anchor 12 is now effectively "locked" into an open position (FIG. 31).

Referring to FIG. 3*a,* to mount the stabilizing bar to the anchor as to allow repeated engagement and disengagement and to prevent loss of the stabilizing bar during use, a return spring 30*c* and return spring stop 30*d* are used. Spring 30*c* being of sufficient inside diameter as to accept the diameter of stabilizing bar 30, is slid over the remainder of plunger leg 30*a* protruding from the lower end of plunger tube 32. Return spring stop 30*d,* being of greater outside diameter than that of spring 30*c* is then permanently affixed to the lowest tip of plunger leg 30*a.* Return spring 30*c* is now sandwiched between return spring stop 30*d* and the lower end of plunger tube 32, thus piviotably attaching stabilizing arm 30 to plunger tube 32 and consequently to anchor 12. The stabilizing bar can now be pulled upward only the distance it takes to compress the return spring mounted on plunger arm 30*a*. The receiver leg, (shorter than that of the plunger leg), is identical in length to that of the compression stroke of return spring 30*c*. Therefore The stabilizing arm can now be readily disengaged from receiver tube 34 and consequently right side panel 13*c* by manually pulling the stabilizing bar upward to compress the return spring, then swinging the stabilizer bar free of receiver tube 34 (FIG. 4). Side panels 13, 13*a*, 13*b* and 13*c* can now be collapsed onto a similar plane, lying flat for easy storage (FIGS. 5, 6).

From the open and locked position, the side of the anchor from which the center stabilizing bar is operated will be refereed to the "upper" or "top" side of the anchor. Conversely, the opposite side facing downward will be refereed to as the "lower" or "bottom" side of the anchor.

The mechanical foundation of the anchor having been described, a number of flukes would now be attached to the anchor in upper and lower configuration in relation to the forward and rearward side panels. Flukes would be attached to the anchor in an arrangement as to allow the anchor to set on whichever side it may fall. To the top of forward side panel 13 are affixed flukes 14 and 14*a*, to the bottom, 16 and 16*a*. Similarly, to the top of rearward panel 13*b* are affixed flukes 18 and 18*a*, to the bottom 20 and 20*a* (FIG. 1).

The preferred embodiment would have these flukes all of equal size about 7 cm wide, 10 cm long, 0.5 cm thick and tapered to a point on the side making contact with the bottom soil. Each fluke would be angled forward at about 40° in relation to its respective side panel.

Described here in the current configuration, the actual length, width, shape, angle number of flukes, and/or their relation in size to each other could vary depending on the application.

Referring now to FIG. 1, an anchor pull ring 26 is affixed to the outside center of forward side panel 13 to facilitate a location to secure a lead arm assembly, shown generally in FIG. 1, and designated at reference numeral 28. On lead arm 28 can be seen lead arm anchor link 28*b* interconnected with an anchor pull ring 26. This interconnection actually would be made prior to affixing pull ring 26 to forward panel 13. An alternate method, (not shown in the drawing) would be the use of a conventional "snap ring" or "anchor shackle" affixed in lieu of anchor link 28*b*. At the opposite end of the lead arm is a lead arm tie-off ring 28*a*. Tie-off ring 28*a* is used to tie-off a conventional anchor line, in turn tied to the boat.

REFERENCE NUMBERS IN DRAWINGS

| | | | |
|---|---|---|---|
| 12 | Collapsible Boat Anchor | 13 | Forward Side Panel |
| 13a | Left Side Panel | 13b | Rearward Side Panel |
| 13c | Right Side Panel | 14 | Upper Left Forward Fluke |
| 14a | Upper Right Forward Fluke | 16 | Lower Left Forward Fluke |
| 16a | Lower Right Forward Fluke | 18 | Upper Left Rearward Fluke |
| 18a | Upper Right Rearward Fluke | 20 | Lower Left Rearward Fluke |
| 20a | Lower Right Rearward Fluke | 22 | Hinge |
| 24 | Hinge Pin | 26 | Anchor Pull Ring |
| 28 | Lead Arm Assembly | 28a | Lead Arm Tie-off Ring |
| 28b | Lead Arm Anchor Link | 30 | Center Stabilizing Bar Assy. |
| 30a | Center Stabilizing Bar Plunger Leg | 30b | Center Stabilizing Bar Receiver Leg |
| 30c | Stabilizing Bar Return Spring | 30d | Return Spring Stop |
| 32 | Plunger Tube | 34 | Receiving Tube |

OPERATION—FIGS. 1, 3, 4, 6, 7 and 8

The manner of using the collapsible anchor will be described in three situations: deployment, retrieval, and storage.

DEPLOYMENT—FIGS. 1, 3, 4, and 7

For deployment, place anchor 12 on a flat surface, for example, the bottom deck of a boat.

Figure 1:
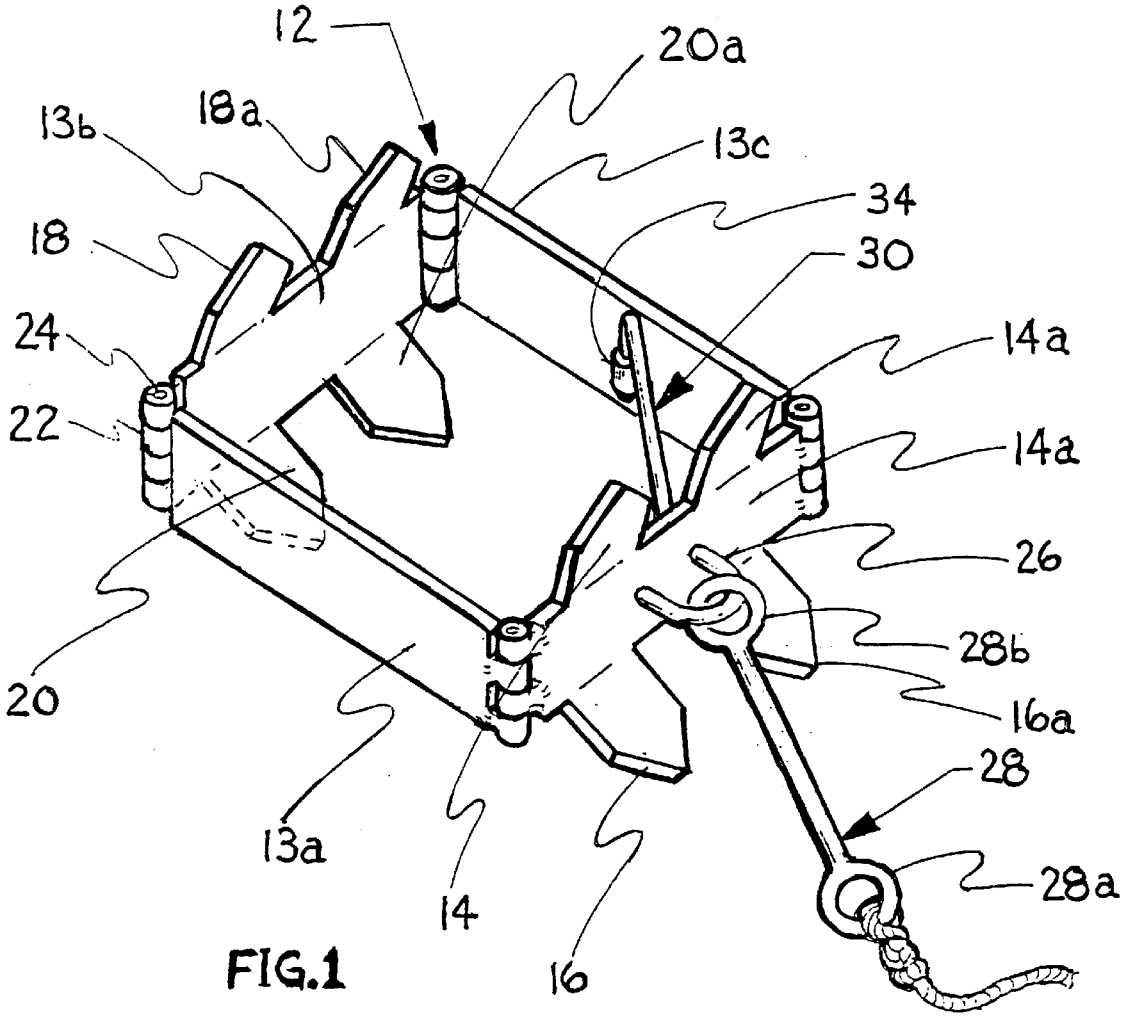
FIG. 1 is a perspective view of the anchor
Figure 2:
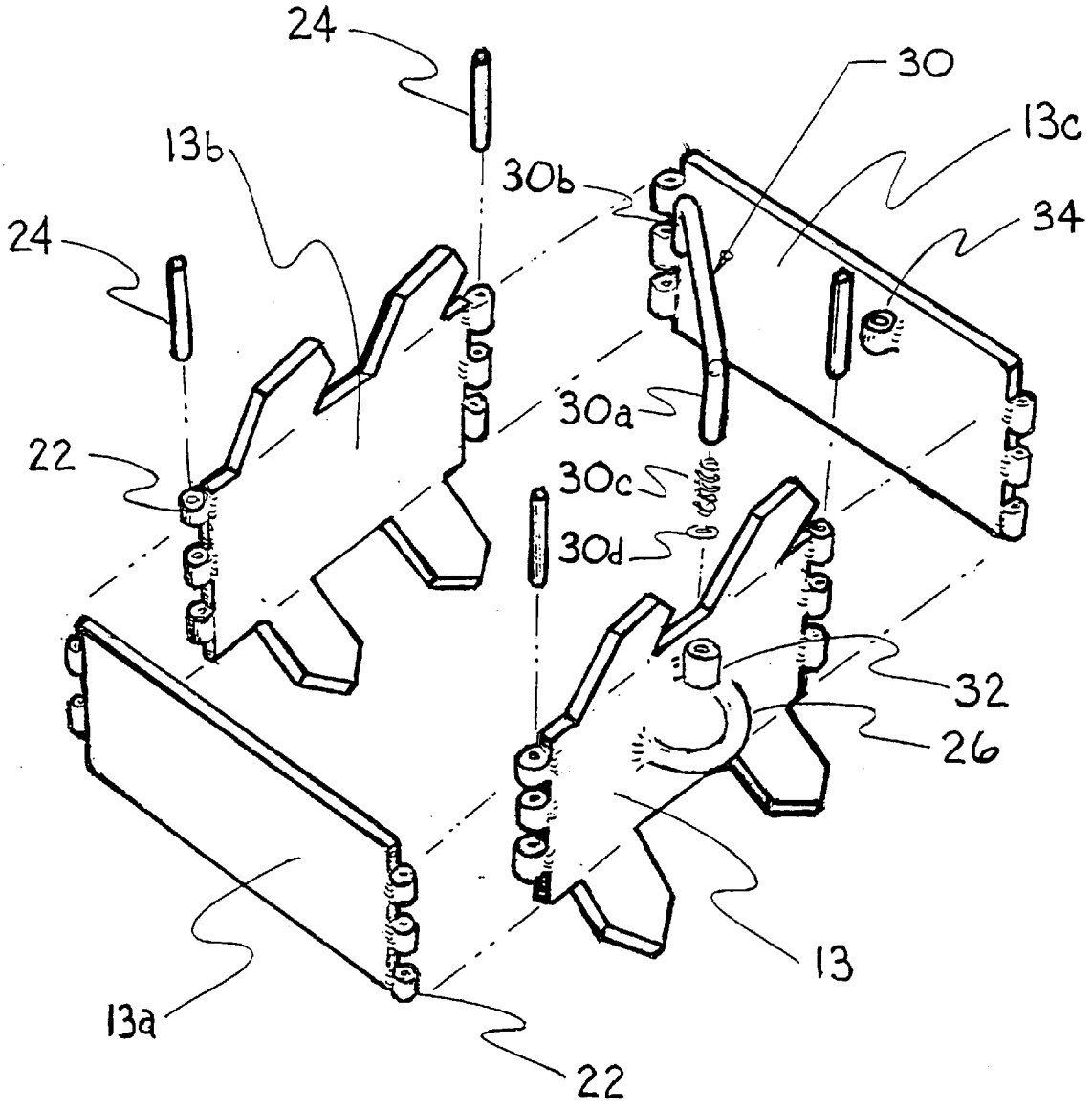
FIG. 2 is an exploded view of the anchor, excluding the lead arm assy.
Figure 3:
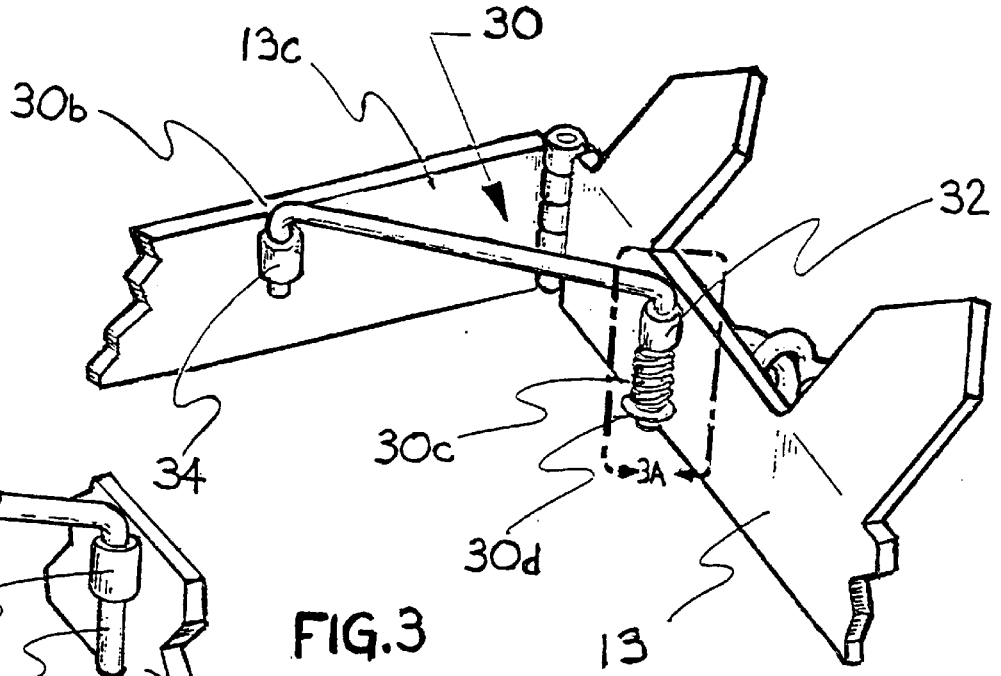
FIG. 3 is a fragmentary view of the anchor showing the stabilizing bar assy.
Figure 3A:
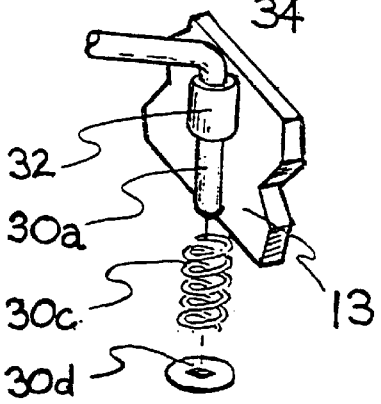
FIG. 3*a* is an exploded detail view of the plunger leg, plunger tube, stabilizing bar return spring and spring stop.
Figure 4:
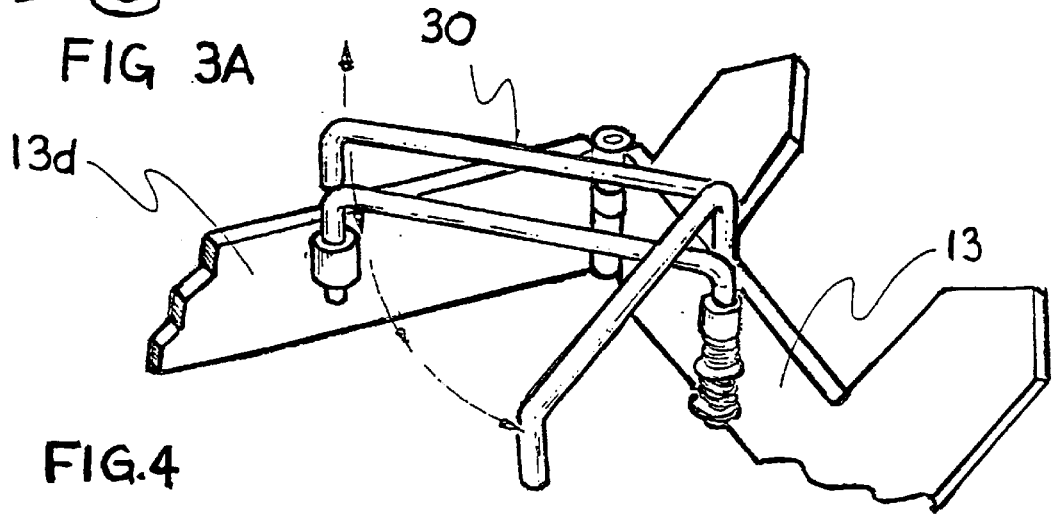
FIG. 4 is a fragmentary view of the anchor showing the operational path of the stabilizing bar.
Figure 5:
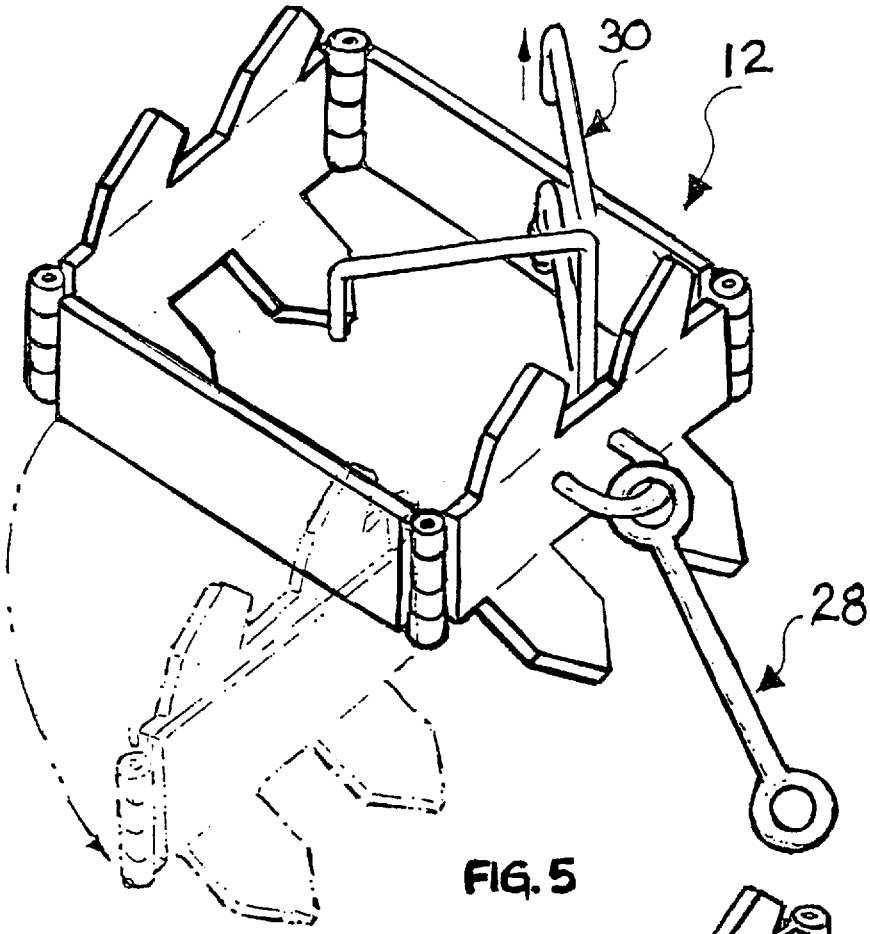
FIG. 5 is a perspective view illustrating the method of collapsing the anchor.

Grasp side panels 13*a* and 13*c* and open the anchor until all the side panels are at right angels to the next, forming the shape of a square (FIG. 1). Place the anchor with the top facing upward. Grasp the stabilizing bar 30 and pull upward while pivoting the stabilizing bar so as to position receiver leg 30*b* directly over receiver tube 34. Release the stabilizing bar and allow return spring 30*c* to pull stabilizing bar 30 downward effectively locking receiver leg 30*b* into receiver tube 34. The anchor is now secure in the open position (FIGS. 3 and 4).

Figure 7:
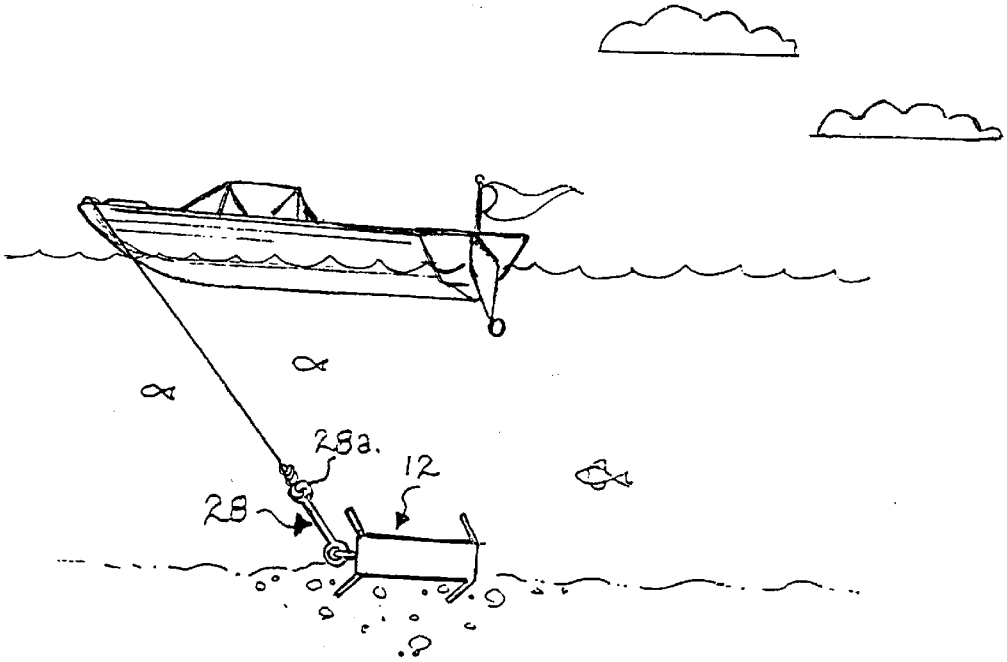
FIG. 7 is an environmental view of the anchor in use.

Secure anchor line to lead arm tie off ring 28*c* and throw the anchor overboard (FIG. 7). Anchor lead chain is not required. The anchor is intended to pull at a 45° angle, allowing the anchor to act as a scoop while requiring less scope on the anchor line than would be normally used.

The lead arm will hold the anchor line clear of the falling anchor, preventing fouling.

Should the anchor fall on its side, the slightest movement from the anchor line will cause the anchor to roll onto its flukes, one side or the other. This can be likened to the ease with which one can tip over a deck of playing cards standing on its side.

RETRIEVAL—FIG. 8

Figure 8:
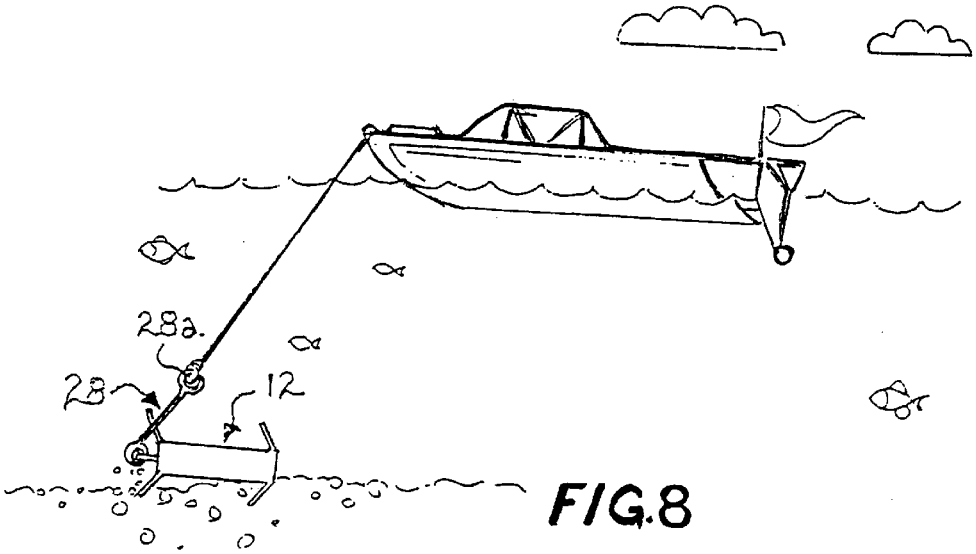
FIG. 8 is an environmental view of the anchor being retrieved.

For retrieval of the anchor, position the boat directly over or slightly behind the location of the anchor (FIG. 8). Pull the anchor line upward, toward the boat.

The anchor, having all of its surface area and holding capacity in a forward direction , has little surface area facing upward. The anchor, unable to keep hold on the vertical facing surfaces while being pulled vertically, releases, allowing the anchor to be pulled back into the boat.

Figure 6:
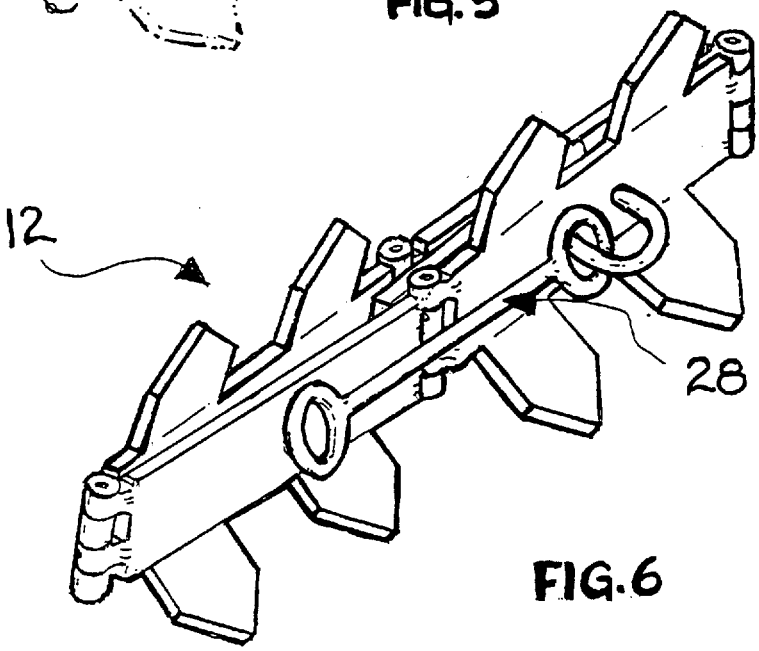
FIG. 6 is a perspective view showing the anchor collapsed for storage

STORAGE—FIGS. 4 and 6

For storage, place the anchor on a flat surface with its top facing upward. Grasp stabilizing bar 30 pulling upward to compress return spring 30*c*. Pivot stabilizing bar 30 moving receiver leg 30*b* to the center of the anchor and away from receiver tube 34 (FIG. 4).

Roll the anchor onto its side and allow hinges 22 to collapse the anchor. Pivot the lead arm to lay flat against foreword side panel 13 and store the anchor (FIG. 6)

CONCLUSIONS, RAMIFICATIONS AND SCOPE

Accordingly, the reader will see the Collapsible Anchor to provide an aggressive, compact, convenient anchor capable of easy retrieval and storage in a very limited space.

While my description contains many specificities, these should not be construed as limitations on the scope of the invention but rather as an exemplification of one preferred embodiment thereof. Many other variations are possible, for example the side panels of the anchor, described and shown as four rectangular hingeably attached side panels to provide a foundation for the anchor. Any number of side panels of varied shape (such as round rod) could be used, either hingeably, pinable, or connectably, to provide a foundation for the anchor. Collapsibility of the sides, ability to set on multiple sides, and ease of removal are the main objects. An anchor of similar characteristics but built for disassembly in lieu of collapsibility would also be desirable.

Means of securing the foundation of the anchor itself on an open position could also include two rings lining up at a predetermined position as to accept a pin, or a boot constructed as to fit into a corner of the anchor, effectively immobilizing the pivot point on the corner.

Similarly, the size, shape, number, location and angle of flukes is also a matter of option, depending on the intended application.

The lead arm, though effective in minimizing the possibility of fouling, could be eliminated altogether and not effect the novelty or usefulness of the anchor.

Accordingly, the scope of the invention should be determined not by the embodiment illustrated, but by the appended claims and their legal equivalents.

What is claimed is:

1. A boat anchor capable of collapsing, comprising;

a.) four elongate sides, each of predetermined length and pivotally connected as to provide a foundation to support a plurality of anchor flukes;

b.) said flukes being affixed to said foundation in an arrangement as to allow said anchor to set on whichever side it may fall;

c.) securing means for engaging and disengaging at least two of said pivotally connected elongate sides for providing an operative and storage configuration respectively, and;

d.) means for attaching an anchor line to said anchor.

2. A boat anchor as described in claim 1 wherein;

said means for attaching an anchor line to said anchor further comprises:

said means for attaching an anchor line to said anchor further comprises:

an elongate lead arm of predetermined length, one end of said lead arm pivotally connected to said anchor at a position on a most forward one of said elongate sides in the direction of pull, the opposing end of said lead arm having affixed to it a ring for securing said anchor line, said lead arm thereby assisting in guiding the direction of pull from said anchor line to said anchor when setting or releasing said anchor and further to prevent said anchor line from fouling said anchor during use.

3. A boat anchor as described in claim 1 wherein;

said plurality of anchor flukes are affixed to said foundation on each of forwardly and rearwardly facing ones of said elongate sides in a top and bottom configuration, thereby providing resistance against the seabed on both leading and trailing edges of said anchor and allowing said anchor to set on whichever side it may fall; top or bottom.

4. A boat anchor as described in claim 1 wherein;

said four pivotally connected elongate sides are each adjacent and perpendicular to the next and pivotally connected end to end so as to form a rectangular foundation for said flukes in said operative configuration, said elongate sides each being of appropriate length as to allow said rectangular foundation to pivotally collapse forming a parallelogram having two opposing acute and two opposing obtuse angles when in said storage configuration.

5. A boat anchor as described in claim 1 wherein;

said four pivotally connected elongate sides being capable of disjunction.

* * * * *